US006264444B1

(12) United States Patent
Nakane et al.

(10) Patent No.: US 6,264,444 B1
(45) Date of Patent: Jul. 24, 2001

(54) SCROLL-TYPE COMPRESSOR HAVING ORBITAL ROTATING MECHANISM ON THE SIDE OF MOVABLE SPIRAL WALL

(75) Inventors: Yoshiyuki Nakane; Toshiro Fujii; Kazuo Murakami; Naoya Yokomachi, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/488,809

(22) Filed: Jan. 21, 2000

(30) Foreign Application Priority Data

Feb. 2, 1999 (JP) ..... 11-024895

(51) Int. Cl.[7] ..... F03C 2/00

(52) U.S. Cl. ..... 418/55.3; 418/55.1; 418/55.2; 418/55.4; 418/183

(58) Field of Search ..... 418/55.2, 55.1, 418/55.3, 55.4, 183

(56) References Cited

U.S. PATENT DOCUMENTS 4,795,323 * 1/1989 Lessie ..... 418/55.3
4,810,176 * 3/1989 Seufuji et al. ..... 418/55.3
5,366,359 * 11/1994 Bookbinder et al. ..... 418/57
5,681,155 * 10/1997 Hisanaga et al. ..... 418/55.6
5,795,141 * 8/1998 Oke et al. ..... 418/57

FOREIGN PATENT DOCUMENTS 55-051982 * 4/1980 (JP) ..... 418/55.3
56-165787 12/1981 (JP) .
57-105582 * 7/1982 (JP) ..... 418/55.3
61-98987 5/1986 (JP) .
62-003101 * 1/1987 (JP) ..... 418/55.3
3-070888 * 3/1991 (JP) ..... 418/55.3

* cited by examiner

*Primary Examiner*—Thomas Denion
*Assistant Examiner*—Theresa Trieu
(74) *Attorney, Agent, or Firm*—Woodcock Washburn Kurtz Mackiewicz & Norris LLP

(57) ABSTRACT

A scroll-type compressor has a front housing, a stationary scroll, and a rear housing arranged in this order. A movable scroll is arranged in a space formed in the front housing and the stationary scroll and opposed to the stationary scroll so that the movable spiral wall engages with the stationary spiral wall. A rotatable shaft is supported by the rear housing and extends through the stationary scroll base plate toward the movable scroll. An orbital rotating mechanism is arranged at the end of the rotatable shaft to cause the movable scroll to orbitally rotate. The orbital rotating mechanism and the rotatable shaft are arranged on the side of the movable spiral wall with respect to the movable scroll base plate.

16 Claims, 8 Drawing Sheets

SCROLL-TYPE COMPRESSOR HAVING ORBITAL ROTATING MECHANISM ON THE SIDE OF MOVABLE SPIRAL WALL

BACKGROUND OF THE INVENTION

1. Field of the Invention

The present invention relates to a scroll-type compressor in which a stationary scroll having a stationary scroll base plate and a stationary spiral wall formed on the stationary scroll base plate is opposed to a movable scroll having a movable scroll base plate and a movable spiral wall formed on the movable scroll base plate, so that closed spaces, the volumes of which are reduced upon the orbital rotation of the movable scroll, are formed between the stationary spiral wall and the movable spiral wall of the movable scroll which orbitally rotates but does not rotate about its own axis, and the movable scroll is rotated by transmitting the rotational force of a rotatable shaft to the orbital rotating mechanism for rotating the movable scroll.

2. Description of the Related Art

The closed spaces become narrower toward the inner ends of the spiral walls of the stationary scroll and the movable scroll upon the rotation of the movable scroll. In the scroll-type compressors disclosed in Japanese Unexamined Patent Publications (Kokai) No. 56-165787, No. 56-165788, No. 61-98987 and No. 3-92502, a gas compressed between the movable scroll and the stationary scroll is discharged to the back surface side of the stationary scroll through a port that extends through the stationary scroll base plate.

As a means to construct the scroll-type compressor in a compact size, means have been proposed according to which the stationary scroll is formed as a part of the housing of the compressor, as disclosed in, for example, Japanese Unexamined Patent Publication (Kokai) No. 56-165787. However, it is difficult to construct the scroll-type compressor in a more compact size.

SUMMARY OF THE INVENTION

The object of the present invention is to construct a scroll-type compressor in a more compact size.

A scroll-type compressor, according to the present invention, comprises a rotatable shaft having an axis, a stationary scroll having a stationary scroll base plate and a stationary spiral wall formed on the stationary scroll base plate, and a movable scroll having a movable scroll base plate and a movable spiral wall formed on the movable scroll base plate, the movable scroll being opposed to the stationary scroll such that closed spaces are defined between the stationary spiral wall and the movable spiral wall, the movable scroll having an axis which does not coincide with the axis of the rotatable shaft. Also, there are provided an orbital rotating mechanism for revolving the movable scroll around the axis of the rotatable shaft, and a rotation preventing mechanism for preventing the rotation of the movable scroll around the axis of the movable scroll. The closed spaces have volumes which are reduced while the movable scroll is rotated around the axis of the rotatable shaft and is prevented from being rotated about the axis of the movable scroll. The compressor is characterized by that the orbital rotating mechanism and the rotatable shaft are arranged on the side of the movable spiral wall with respect to the movable scroll base plate.

According to the constitution of the present invention, which is different from the conventional constitution in which the an orbital rotating mechanism and a rotatable shaft are arranged on the back surface side of the movable scroll base plate, it is allowed to shorten the size of the scroll-type compressor in the axial direction of the rotatable shaft.

Preferably, the movable scroll is disposed between the stationary scroll and the front housing. The front housing forms a portion of the housing for holding the movable scroll that rotates.

Preferably, a discharge chamber is provided on the back surface side of the movable scroll base plate, and a compressed gas is discharged into the discharge chamber from the final closed space so that the pressure in the discharge chamber acts upon the back surface of the movable scroll base plate.

The discharge chamber is a discharge pressure region, and the pressure in the discharge pressure region acts as a back pressure on the movable scroll base plate.

Preferably, the discharge chamber is formed in the front housing. The interior of the front housing is best suited as a place for forming the blow-out chamber.

Preferably, the discharge chamber is surrounded by a sealing device interposed between the front housing and the movable scroll base plate.

The sealing device prevents leakage of the compressed gas from the discharge chamber through a gap between the front housing and the movable scroll base plate.

Preferably, a discharge port is formed through the movable scroll base plate to discharge a fluid from the final closed space into the discharge chamber, and a discharge valve is mounted on the back surface of the movable scroll base plate so as to open and close the discharge port.

The compressed gas in the final closed space is discharged into the discharge chamber by pushing the discharge valve that turns integrally with the movable scroll that rotates.

Preferably, a pressure-receiving plate is interposed between the front housing and the movable scroll base plate.

When the front housing and the movable scroll are made of, for example, a material containing aluminum to decrease the weight, there takes place a sliding contact between the same materials, which is not desirable. The pressure-receiving plate that comes into sliding contact with the movable scroll is made of, for example, an iron material to avoid a sliding contact between the same materials.

Preferably, the sealing device comprises a first seal ring interposed between the front housing and the pressure-receiving plate, and a second seal ring interposed between the movable scroll base plate and the pressure-receiving plate.

The first and second seal rings prevent the leakage of the compressed gas from the discharge chamber through a gap between the front housing and the movable scroll base plate.

Preferably, the stationary scroll is disposed between the movable scroll and a rear housing. The rear housing forms a part of the housing for holding the movable scroll that revolves.

Preferably, the rear housing supports one end of the rotatable shaft via a radial bearing. The constitution for supporting the rotatable shaft by the rear housing is simple. The other end of the rotatable shaft is supported by a motor housing attached to the rear housing.

Preferably, the orbital rotating mechanism includes an eccentric shaft that rotates integrally with the rotatable shaft and a bearing means interposed between the movable scroll and the eccentric shaft, the bearing means being held in a boss portion that protrudes from the movable scroll base plate toward the movable spiral wall.

Preferably, the stationary scroll base plate surrounds the cylinder.

Preferably, the rotation preventing mechanism is disposed between the movable scroll base plate and the front housing to prevent the rotation of the movable scroll that rotates.

Preferably, the rotation preventing mechanism includes pins of a cylindrical shape mounted on either the front housing or the movable scroll base plate, and holes of a circular shape formed in the other one of either the front housing or the movable scroll base plate, the pins being inserted in the holes in a manner that the outer peripheral surfaces thereof contact the inner peripheral surfaces of the holes.

A gap between the front housing and the movable scroll base plate is best suited for arranging the rotation preventing mechanism.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

The first preferred embodiment of the present invention will now be described with reference to FIGS. 1 to 4.

Figure 1:
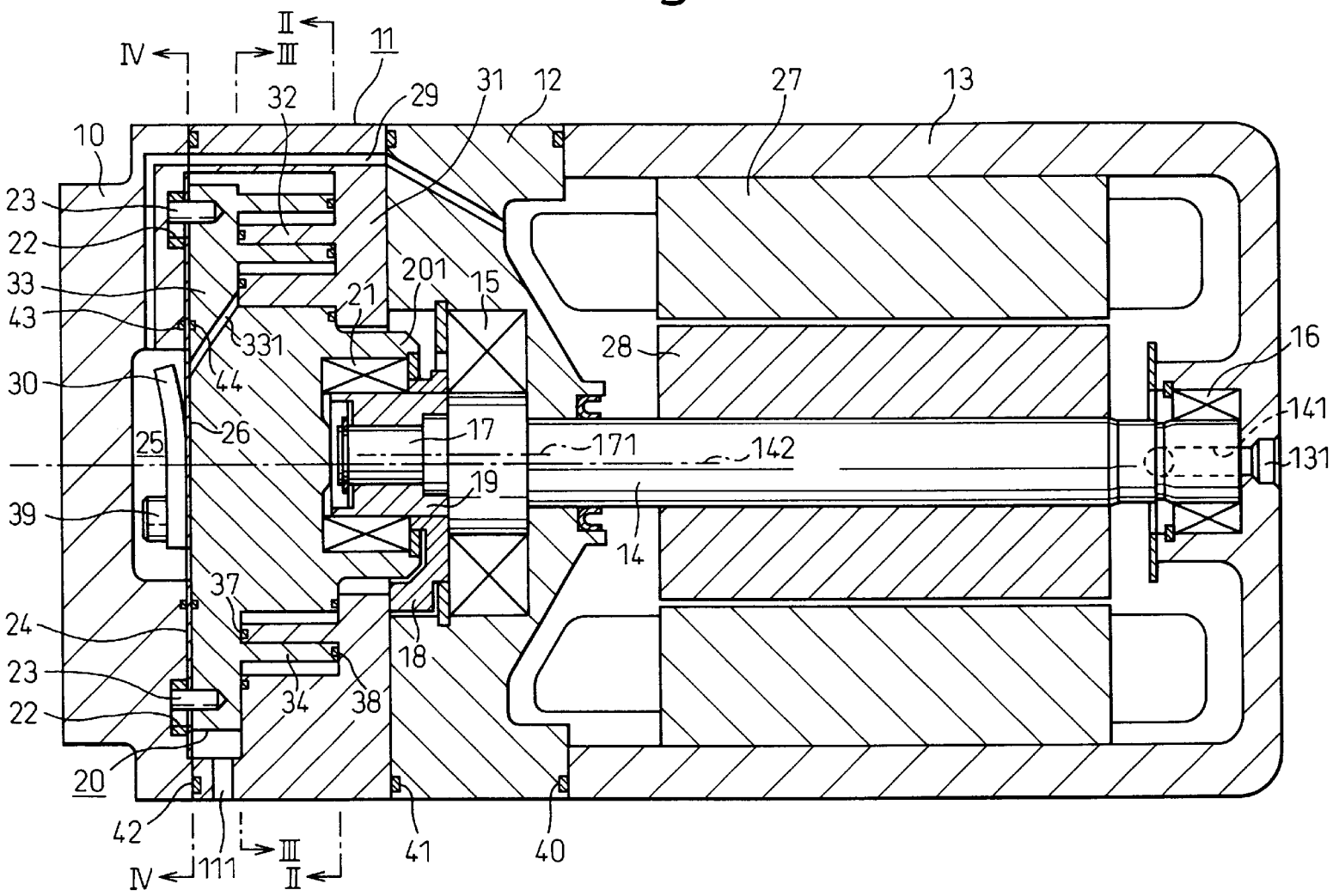
FIG. 1 is a side sectional view of a compressor according to the first embodiments of the present invention.

Referring to FIG. 1, the compressor includes a front housing 10, a stationary scroll 11, a movable scroll 20, a rear housing 12, and a motor housing 13. The rear housing 12 is joined to the motor housing 13, and a seal ring 40 is interposed between the adjoining surfaces of the motor housing 13 and rear housing 12. The stationary scroll 11 is joined to the rear housing 12, and a seal ring 41 is interposed between the rear housing 12 and the stationary scroll 11. The front housing 10 is joined to the stationary scroll 11, and a seal ring 42 is interposed between the adjoining surfaces of the stationary scroll 11 and the front housing 10. A rotatable shaft 14 is rotatably supported by the rear housing 12 and the motor housing 13 through radial bearings 15 and 16. An eccentric shaft 17 is integrally formed with the rotatable shaft 14. A balance weight 18 and a bush 19 are supported by the eccentric shaft 17.

The stationary scroll 11 has a stationary scroll base plate 31 and a stationary spiral wall 32 integrally formed on the stationary scroll base plate 31. Similarly, the movable scroll 20 has a movable scroll base plate 33 and a movable spiral wall 34 integrally formed on the movable scroll base plate 33. The outer peripheral portion of the stationary scroll 11 constitutes a part of the housing of the compressor.

The movable scroll 20 is arranged between the front housing 10 and the stationary scroll 11 and opposed to the latter so that the movable spiral wall 34 engages with the stationary spiral wall 32. The movable scroll 20 has a boss portion 201 on the side of a movable spiral wall 34. The bush 19 is fitted on the eccentric shaft 17 and inserted in the cavity of the boss portion 201, and a needle bearing 21 is interposed between the bush 19 and the inner surface of the cavity of the boss portion 201. That is, the movable scroll 20 is supported by the bush 19 so as to rotate relative to the latter via the boss portion 201 and the needle bearing 21 which is a bearing means. Closed spaces S0, S1 and S2 are formed by the stationary base plate 31, the stationary spiral wall 32 of the stationary scroll 11, the movable scroll base plate 33, and the movable spiral wall 34 of the movable scroll 20. The movable scroll 20 orbitally rotates around the axis of the axis of the rotatable shaft 14 while the eccentric shaft 17 rotates, and the balance weight 18 cancels a centrifugal force produced by the rotation of the movable scroll 20.

Figure 4:
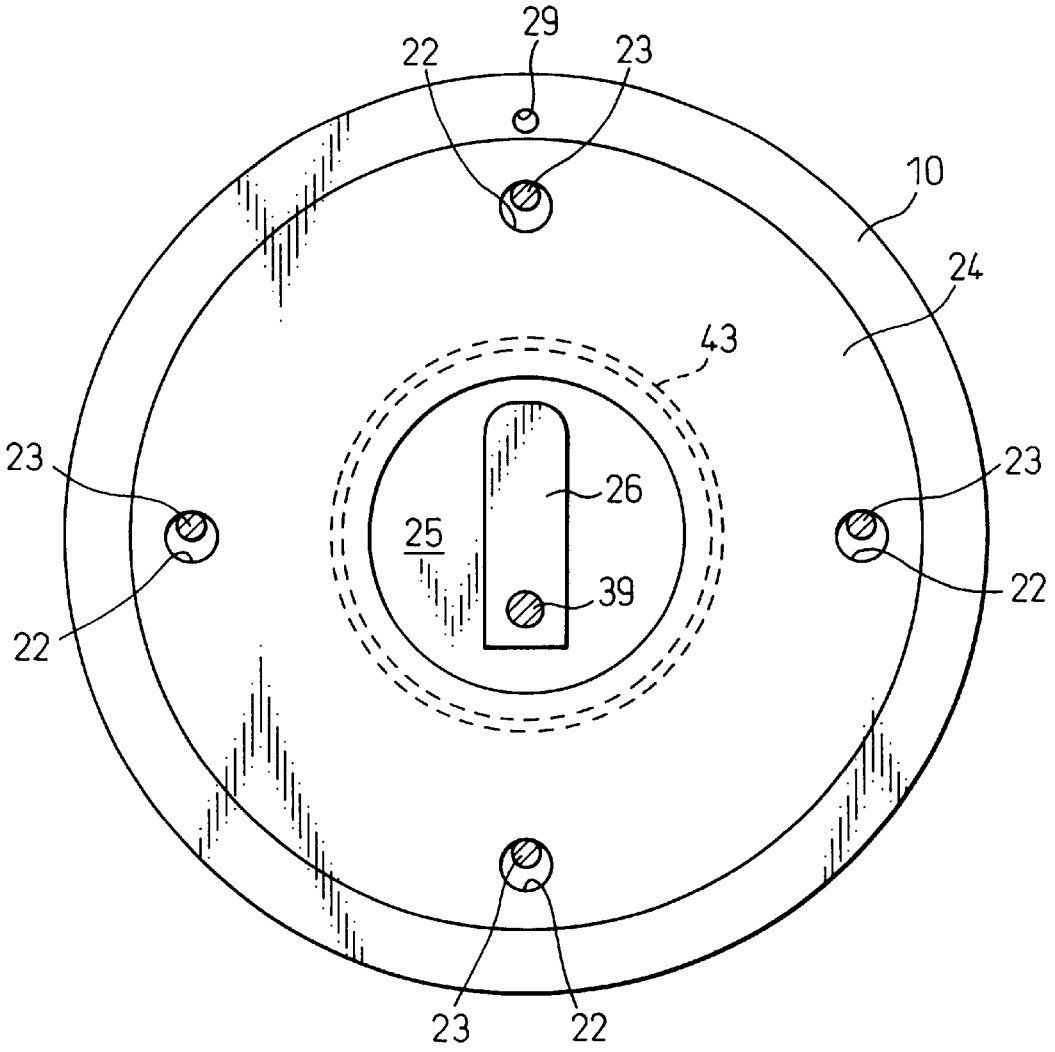
FIG. 4 is a sectional view, taken along the line IV—IV in FIG. 1.

A plurality (four in this embodiment) of rotation preventing pins 23 of a cylindrical shape are attached to the back surface of the movable scroll base plate 33. A pressure-receiving plate 24 is interposed between the front housing 10 and the movable scroll base plate 33. Referring to FIG. 4, rotation preventing holes 22 of a number equal to that of the rotation preventing pins 23 are circumferentially arranged in the pressure-receiving plate 24 and in the front housing 10. The rotation preventing holes 22 are arranged at positions maintaining an equal distance or angle, and the ends of the rotation preventing pins 23 are inserted in the rotation preventing holes 22. The front housing 10 forms a portion of the housing for accommodating the movable scroll 20. Also, the stationary scroll 11 and the rear housing 12 form portions of the housing for accommodating the movable scroll 20.

A stator 27 is attached to the inner peripheral surface of the motor housing 13, and a rotor 28 is supported by the rotatable shaft 14. By supplying electric current to the stator 27, the rotor 28 and the rotatable shaft 14 rotate together.

The movable scroll 20 orbitally rotates around the axis of the rotatable shaft 14 upon the rotation of the eccentric shaft 17 integrally formed with the rotatable shaft 14, and a coolant gas introduced into an inlet 111 in the peripheral wall of the stationary scroll 11 flows into a space between the stationary scroll base plate 31 and the movable scroll base plate 33 at the peripheral region of the stationary and movable scrolls 11 and 20. The interior in the boss portion 201 is maintained as a suction pressure region. Upon the rotation of the movable scroll 20, the outer peripheral surfaces of the rotation preventing pins 23 make sliding contact with the inner peripheral surfaces of the rotation preventing holes 22. The relationship $D=d+2r$ is maintained among the diameter D of the rotation preventing holes 22, the diameter d of the rotation preventing pins 23, and the radius r of rotation of the bush 19. Due to this relationship, the radius of rotation of the movable scroll 20 is specified to be r.

The movable scroll 20 tends to rotate about the center axis of the bush 19, i.e., about the center axis 171 of the eccentric shaft 17. However, since not less than three rotation preventing pins 23 attached to the movable scroll base plate 33 are in contact with the inner peripheral surfaces of the rotation preventing holes 22, the movable scroll 20 does not rotate about the center axis of the bush 19. That is, the movable scroll 20 does not rotate about its own axis but only rotates orbitally.

A discharge chamber 25 is formed in the front housing 10 at the radially center thereof. A discharge valve 26 and a retainer 30 are fastened to the back surface of the movable scroll base plate 33 in the discharge chamber 25 by a screw 39. The volumes of the closed spaces S2, S1 and S0 are reduced upon the rotation of the movable scroll 20, and become smaller toward the inner ends of the spiral walls 32 and 34 of the two scrolls 11 and 20. The compressed coolant gas is discharged into the discharge chamber 25 from the final closed space through the discharge port 331 in the movable scroll base plate 33, pushing and opening the discharge valve 26. The opening degree of the discharge valve 26 is limited by the retainer 30. Reaction force to the compression action in the closed spaces S2, S1 and S0 acting on the movable scroll 20 are received by the front housing 10 through the pressure-receiving plate 24.

A first seal ring 43 is interposed between the front housing 10 and the pressure-receiving plate 24 so as to surround the discharge chamber 25. A second seal ring 44 is interposed between the movable scroll base plate 33 and the pressure-receiving plate 24 so as to surround the discharge chamber 25. The seal rings 43 and 44 work to prevent the leakage of gas from the discharge chamber 25 which is a high pressure, discharge pressure region to a low pressure region between the stationary scroll 11 and the movable scroll 20.

Referring to FIG. 1, the interior of the motor housing 13 is communicated with the discharge chamber 25 through a discharge passage 29. The coolant gas in the discharge chamber 25 is discharged into the motor housing 13 through the discharge passage 29. The coolant gas in the motor housing 13 which establishes the discharge pressure region goes to an external coolant circuit through a passage 141 in the rotatable shaft 14 and an outlet 131 in the end wall of the motor housing 13.

Figure 2:
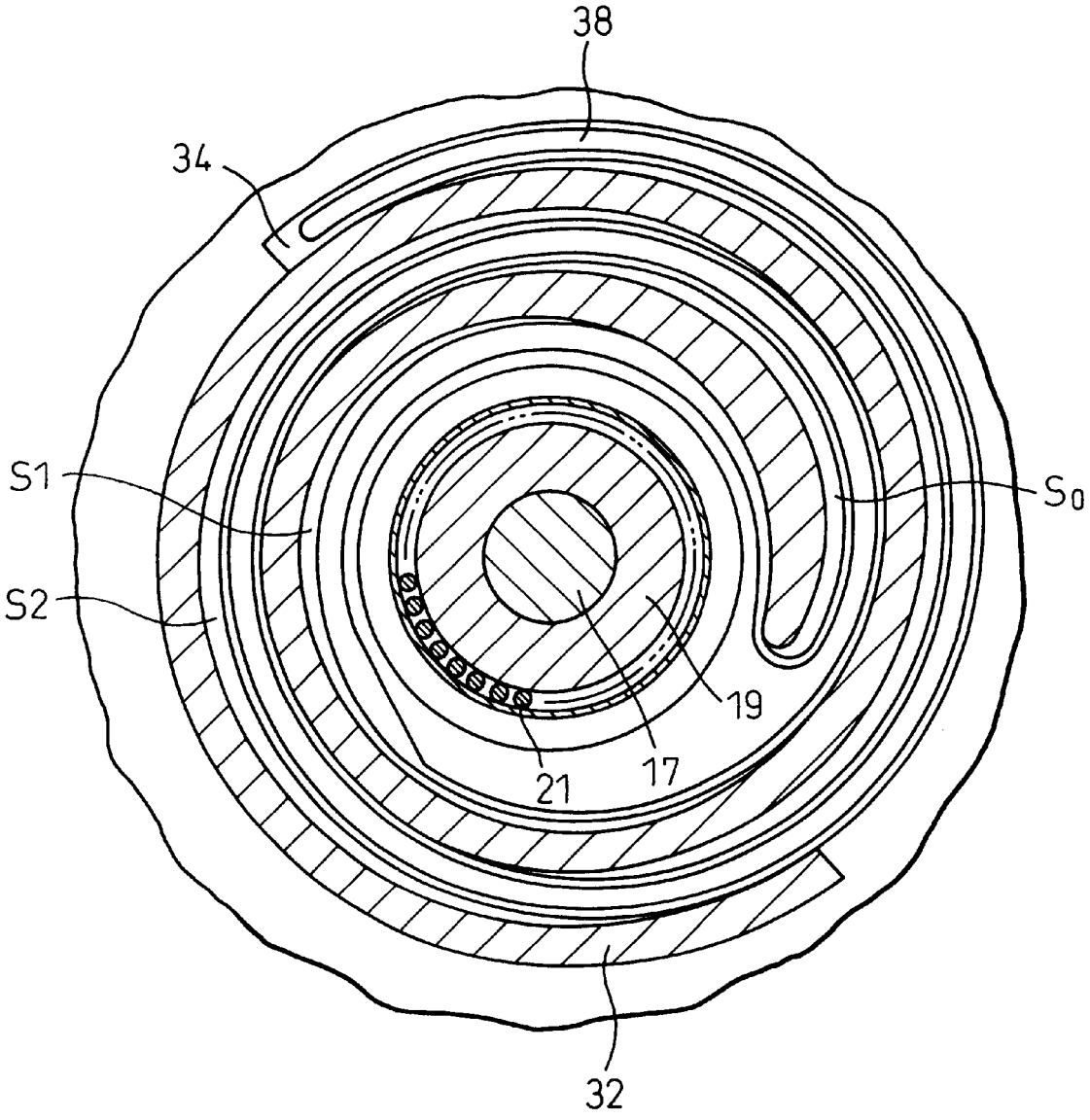
FIG. 2 is a sectional view, taken along the line II—II in FIG. 1.
Figure 3:
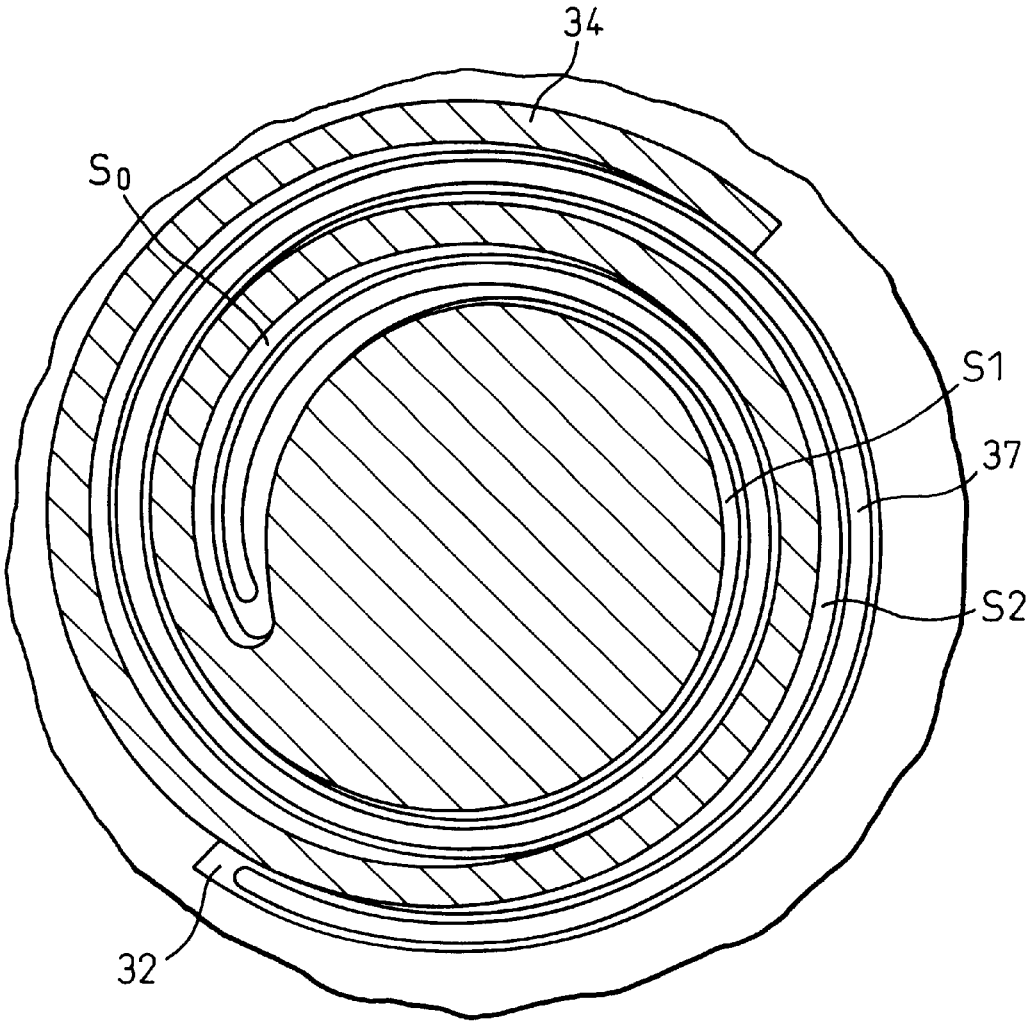
FIG. 3 is a sectional view, taken along the line III—III in FIG. 1.

Referring to FIG. 3, a spiral sealing member 37 made of a synthetic resin is fitted in and supported by the end surface of the stationary spiral wall 32. Referring to FIG. 2, a spiral sealing member 38 made of a synthetic resin is fitted in and supported by the end surface of the movable spiral wall 34. The pressures are different in the closed spaces S0, S1 and S2. A difference in the pressure among the neighboring closed spaces S0, S1 and S2 pushes the sealing member 37 against the movable scroll base plate 33, and pushes the sealing member 38 against the stationary scroll base plate 31. These pushing actions enhance the sealing performance of the closed spaces S0, S1 and S2.

The following effects are obtained by the first preferred embodiment.

(1-1) The eccentric shaft 17, the bush 19 and the needle bearing 21 constitute the orbital rotating mechanism for rotating the movable scroll 20 around the axis of the rotatable shaft. The orbital rotating mechanism and the rotatable shaft 14 are arranged on the side of the movable spiral wall 34 with respect to the movable scroll base plate 33, and the stationary scroll base plate 31 is disposed at a position to surround the boss portion 201 and the eccentric shaft 17. That is, the stationary scroll base plate 31 has a bore through which the boss portion 201 rotatably extends. In the conventional mechanism in which the orbital rotating mechanism and the rotatable shaft are arranged on the back surface side of the movable scroll base plate, the stationary scroll should be disposed at a position near the position of the front housing 10 in FIG. 1, and a space for forming the discharge chamber must be provided on the further front side (left side in FIG. 1) of the front housing 10 of the compressor of this embodiment. Therefore, the constitution in which the orbital rotating mechanism and the rotatable shaft 14 are arranged on the side of the movable spiral wall 34 with respect to the movable scroll base plate 33 makes it possible to shorten the length of the scroll-type compressor in the axial direction of the rotary shaft 14.

(1-2) The pressure in the discharge chamber 25 establishing the discharge pressure region acts on the back surface of the movable scroll base plate 33. This pressure serves as a back pressure against the pressure between the stationary scroll 11 and the movable scroll 20. The pressure between the stationary scroll 11 and the movable scroll 20 pushes the movable scroll base plate 33 onto the pressure-receiving plate 24. When the movable scroll base plate 33 is pushed by a strong force onto the pressure-receiving plate 24, an increased load is exerted on the needle bearing 21 and the bush 19 that constitutes the orbital rotating mechanism. The back pressure decreases the pushing force, and a decrease in the pushing force decreases the load exerted on the bush 19 and the needle bearing 21. A decrease in the load on the orbital rotating mechanism helps improve the reliability of the orbital rotating mechanism. As the rotatable shaft 14 starts rotating, i.e., as the compressor starts working, the compressed gas is readily sent into the discharge chamber 25, and the back pressure readily works as the compressor starts working. This further improves the reliability of the orbital rotating mechanism.

(1-3) The interior of the front housing 10 is best suited for forming the discharge chamber 25 that also works as a back pressure chamber for the movable scroll 20.

(1-4) The discharge valve 26 for opening and closing the discharge port 331 is fastened to the movable scroll base plate 33. The discharge port 331 is opened and closed reliably and most simply by a constitution in which the discharge valve 26 is fastened to the movable scroll base plate 33 to open and close the discharge port 331 that turns with the movable scroll 20.

(1-5) The screw 39 for fastening the discharge valve 26 and the retainer 30 to the movable scroll base plate 33 is screwed at a position away from the center axis 171 of the eccentric shaft 17 toward the center axis 142 of the rotatable shaft 14. The center of gravity of the discharge valve 26, the retainer 30 and the screw 39 as a whole is away from the center axis 171 of the eccentric shaft 17 toward the center axis 142 of the rotatable shaft 14. Therefore, the discharge valve 26, the retainer 30 and the screw 39 play the same role as a balance weight 18.

(1-6) When the front housing 10 and the movable scroll 20 are made of, for example, a material containing aluminum for decreasing the weight, there takes place sliding contact between the front housing 10 and the movable scroll 20 made of the same material, which is not desirable. The movable scroll 20 comes into sliding contact with the pressure-receiving plate 24. By forming the pressure-receiving plate 24 using, for example, an iron material, a sliding contact between the same materials is avoided.

(1-7) The first seal ring 43 and the second seal ring 44 prevent the leakage of a high pressure gas from the discharge chamber 25 through a gap between the front housing 10 and the pressure-receiving plate 24 and between the movable scroll base plate 33 and the pressure-receiving plate 24.

(1-8) A simple constitution is realized by supporting the rotatable shaft 14 by the rear housing 12 that forms a portion of the housing accommodating the movable scroll 20.

(1-9) The rotation preventing mechanism is constituted by the rotation preventing holes 22 and the rotation preventing pins 23 provided between the movable scroll base plate 33 and the front housing 10. A gap between the movable scroll base plate 33 and the front housing 10 is best suited as a position for installing the rotation preventing mechanism.

Figure 5:
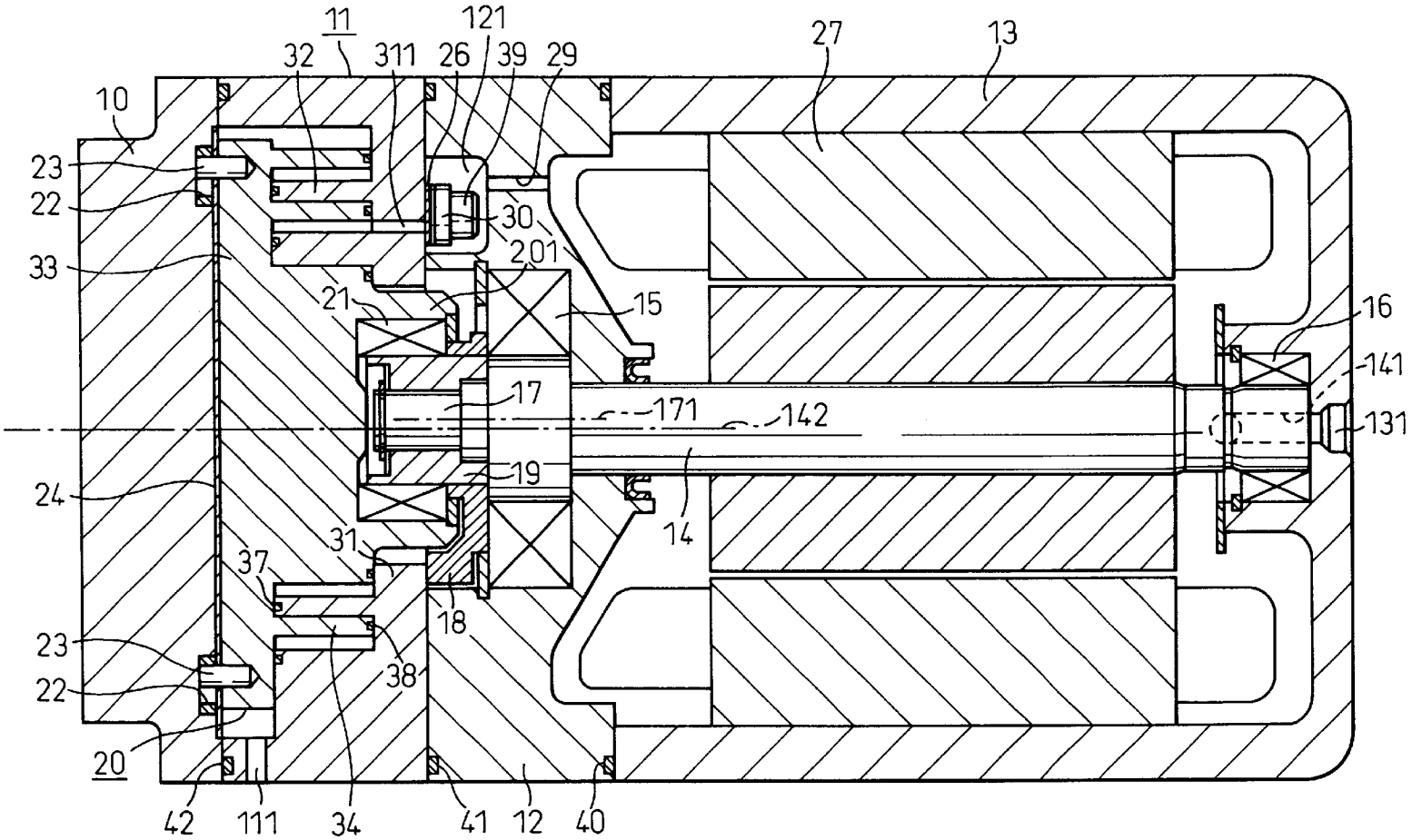
FIG. 5 is a side sectional view of a major portion of a compressor according to the second embodiment of the present invention.

Next, the second preferred embodiment shown in FIG. 5 is described below. The same constituent portions as those of the first embodiment are denoted by the same reference numerals.

According to this embodiment, a discharge chamber 121 is formed in the rear housing 12, and a discharge port 311 is formed in the stationary scroll base plate 31. The compressed gas in the final closed space is discharged into the discharge chamber 121 from the discharge port 311. The rear housing 12 on the back surface side of the stationary scroll base plate 31 supports, from the back side, the stationary scroll 11 that receives the pressure in the closed space, and the deflection or deformation of the stationary scroll base plate 31 caused by the pressure in the closed space is suppressed by the supporting action of the rear housing 12. The rear housing 12 that plays such a role is suited as a place for forming the discharge chamber 121.

Figure 6:
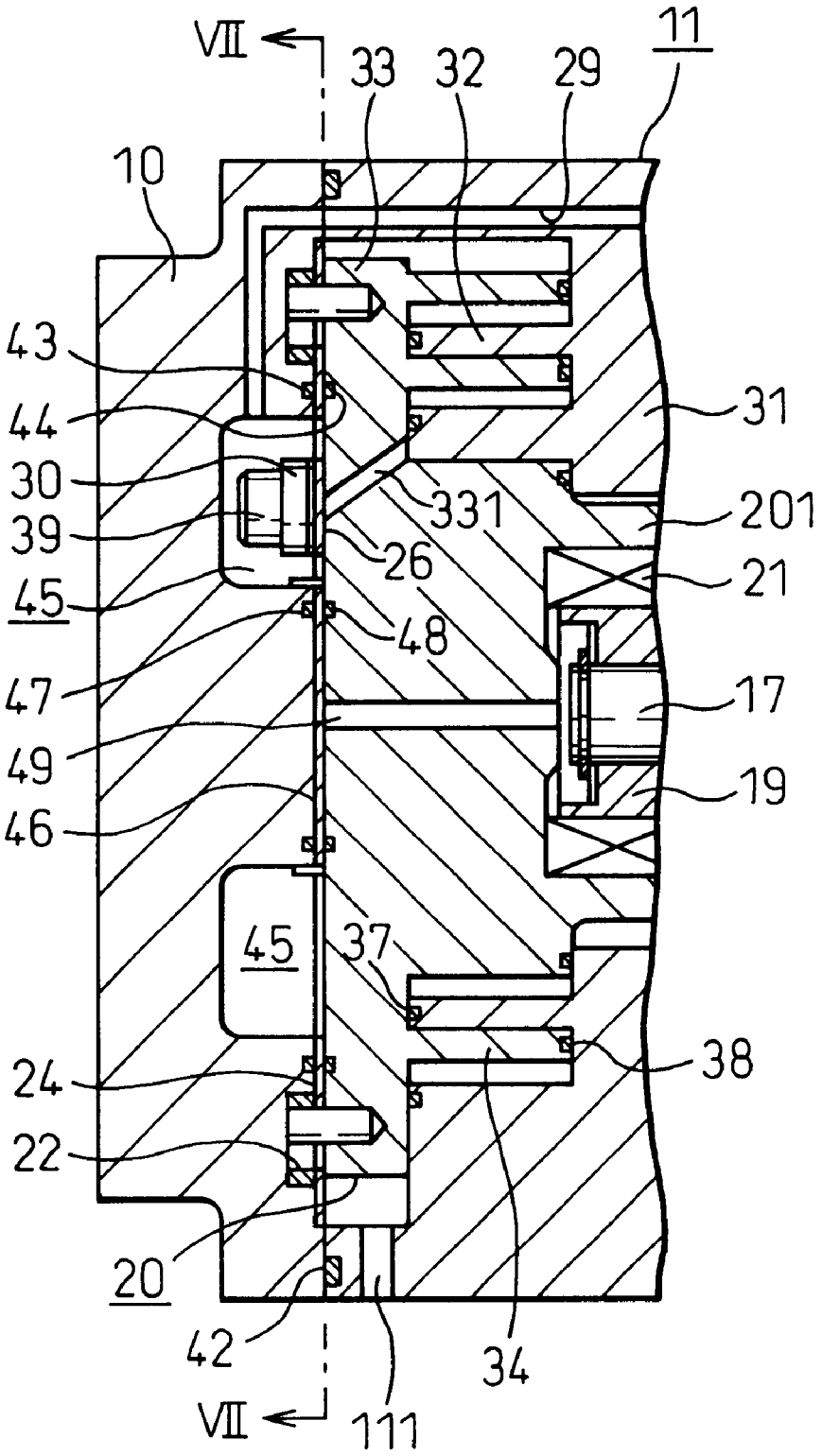
FIG. 6 is a side sectional view of a major portion of a compressor according to the third embodiment of the present invention.
Figure 7:
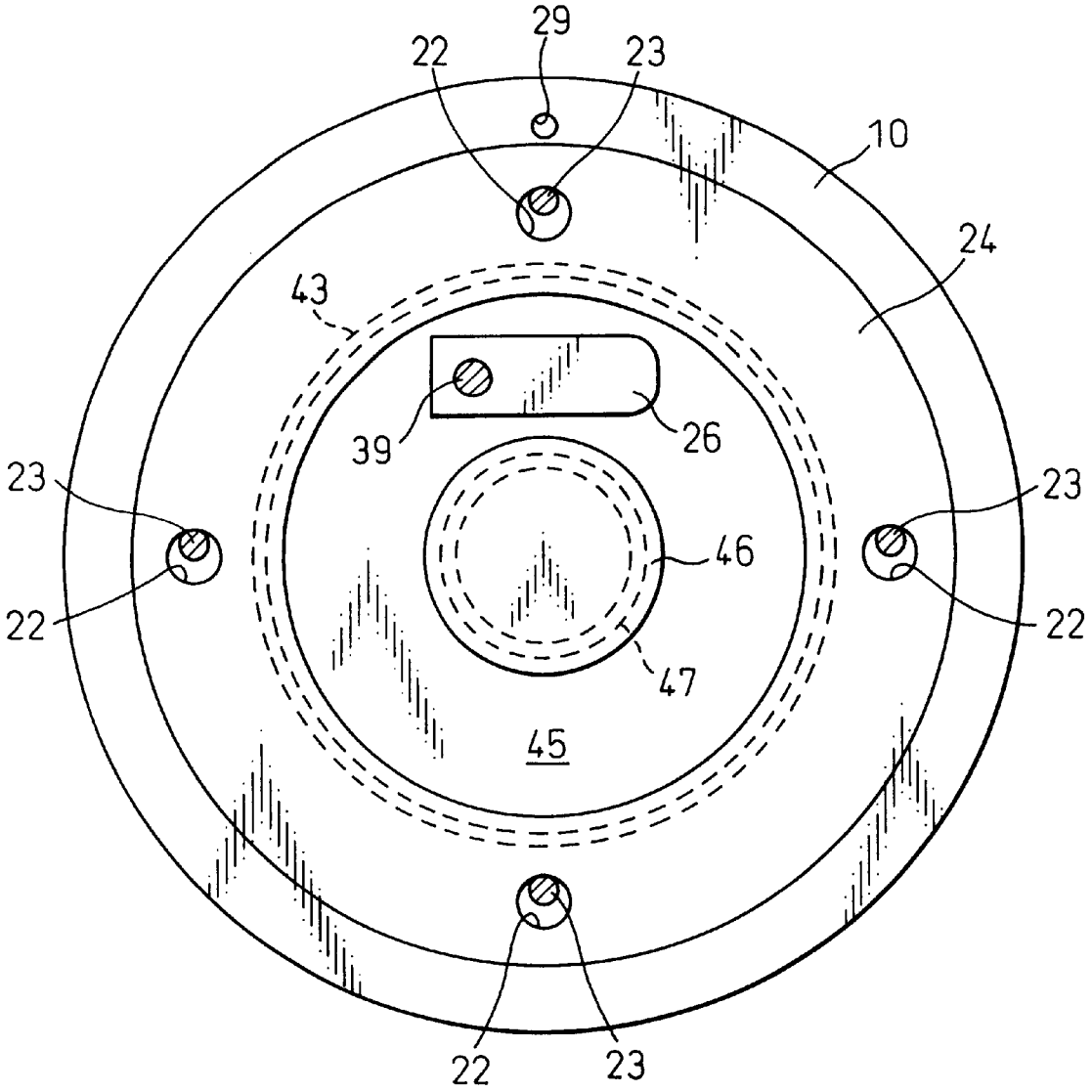
FIG. 7 is a sectional view, taken along the line VII—VII in FIG. 6.

Next, the third preferred embodiment will be described with reference to FIGS. 6 and 7. Constituent portions the same as those of the first embodiment are denoted by the same reference numerals.

A discharge chamber 45 formed in the front housing 10 has an annular shape. A seal ring 47 is interposed between the peripheral portion of the pressure-receiving plate 46 and the front housing 10, and a seal ring 48 is interposed between the peripheral portion of the pressure-receiving plate 46 and the movable scroll base plate 33. A gap between the pressure-receiving plate 46 and the front housing 10, and a gap between the pressure-receiving plate 46 and the movable scroll base plate 33, are communicated with an intake pressure region in the boss portion 201 through a passage 49. The seal rings 47 and 48 prevent the leakage of gas from the discharge chamber 45 into the intake pressure region.

The annular discharge chamber 45 is located at a position corresponding to the closed space on the center side, and the pressure in the discharge chamber 45 opposes the pressure in the closed space on the center side through the movable scroll base plate 33. The constitution in which the high pressure in the closed space on the center side opposes the pressure in the discharge chamber 45 in the axial direction of the rotatable shaft 14, is effective in preventing the movable scroll base plate 33 from being deflected or deformed.

Figure 8:
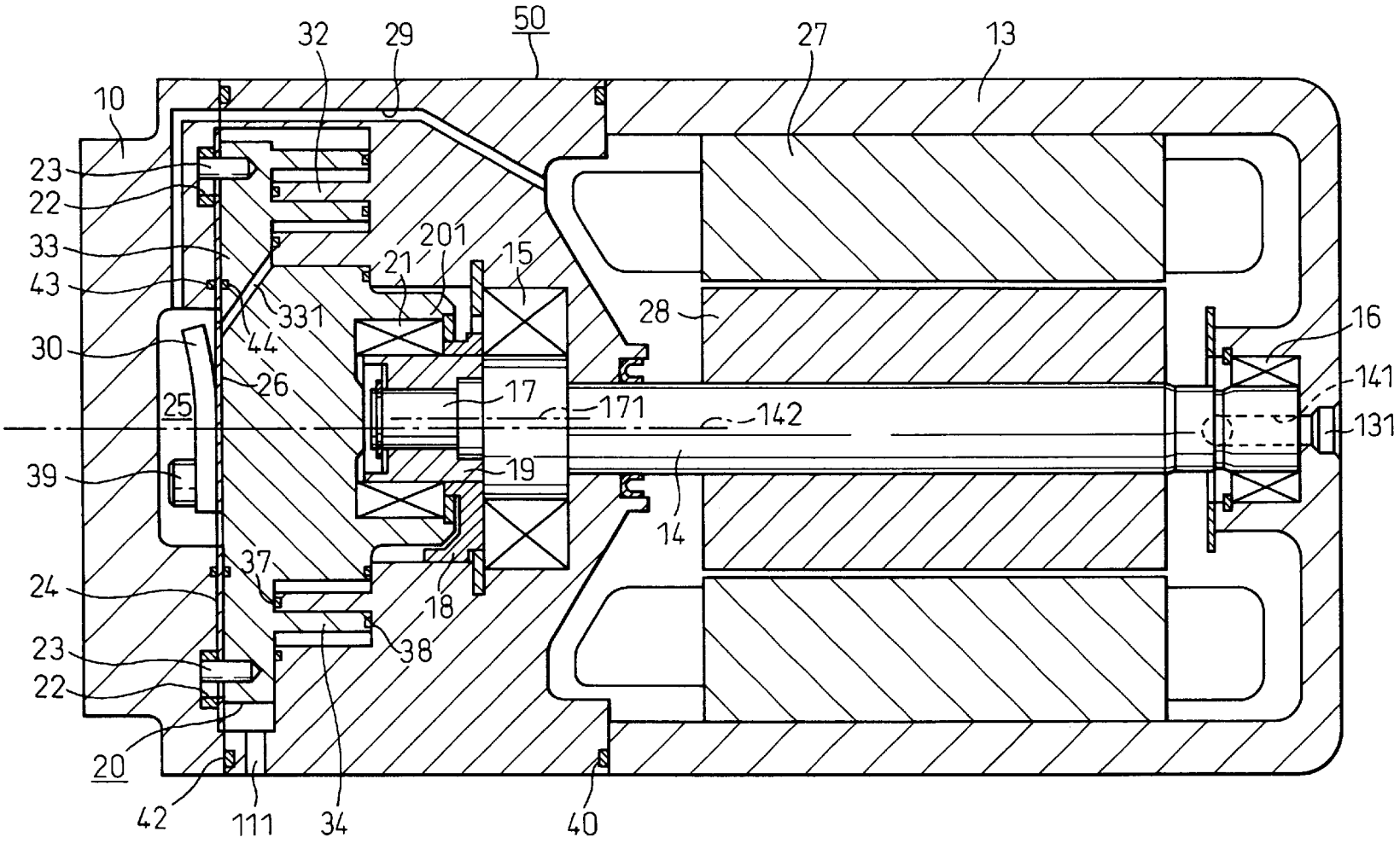
FIG. 8 is a side sectional view of a major portion of a compressor according to the fourth embodiment of the present invention.

Next, the fourth preferred embodiment shown in FIG. 8 is described below. Constituent portions the same as those of the first embodiment are denoted by the same reference numerals.

A stationary scroll 50 in this embodiment also serves as the rear housing in the first embodiment. This combined constitution contributes to decreasing the number of parts of the compressor.

According to the present invention, the following embodiments are further involved.

(1) In the second embodiment, a back pressure chamber is formed on the back surface side of the movable scroll base plate 33 and is communicated with the discharge chamber 121.

(2) In the third embodiment, the rotation preventing holes 22 are formed in the portion of the pressure-receiving plate 46.

(3) In the first embodiment, the rotation preventing holes 22 are formed in the movable scroll base plate 33, and the rotation preventing pins 23 are secured to the front housing 10.

The inventions that can be comprehended from the above-mentioned embodiments other than those recited in the claims will be described below together with their effects.

(1) A scroll-type compressor in which a discharge chamber is provided on the back surface side of the stationary scroll base plate, and a compressed gas is discharged into the discharge chamber from the final closed space.

The back surface side of the stationary scroll base plate is suited as a place for forming the discharge chamber.

(2) A scroll-type compressor in which the stationary scroll is disposed between the movable scroll and the rear housing, and the discharge chamber is formed in the rear housing.

The interior of the rear housing is suited as a place for forming the discharge chamber.

According to the present invention as described above in detail, the orbital rotating mechanism and the rotatable shaft are provided on the side of the movable spiral wall with respect to the movable scroll base plate, offering such an excellent effect that the scroll-type compressor can be constructed in a more compact size.

What is claimed is:

1. A scroll-type compressor comprising:

a rotatable shaft having an axis;

a stationary scroll having a stationary scroll base plate and a stationary spiral wall formed on the stationary scroll base plate;

a movable scroll having a movable scroll base plate and a movable spiral wall formed on the movable scroll base plate, said movable scroll being opposed to said stationary scroll such that closed spaces are defined between said stationary spiral wall and said movable spiral wall, said movable scroll having an axis which does not coincide with said axis of said rotatable shaft;

an orbital rotating mechanism for revolving said movable scroll around said axis of said rotatable shaft;

a rotation preventing mechanism for preventing the rotation of said movable scroll around said axis of said movable scroll, said closed spaces having volumes which are reduced while said movable scroll is rotated around said axis of said rotatable shaft and is prevented from being rotated about said axis of said movable scroll; and a discharge chamber arranged on the back side of said movable scroll base plate opposite to said movable spiral wall so that a compressed gas is discharged from the final closed space into said discharge chamber and the pressure in said discharge chamber acts on the back surface of said movable scroll base plate;

wherein said orbital rotating mechanism and said rotatable shaft are arranged on the side of said movable spiral wall with respect to said movable scroll base plate.

2. A scroll-type compressor according to claim 1, further comprising a front housing attached to said stationary scroll, said movable scroll being arranged between said stationary scroll and said front housing.

3. A scroll-type compressor according to claim 2, wherein said discharge chamber is formed in said front housing.

4. A scroll-type compressor according to claim 3, further comprising a sealing device arranged between said front housing and said movable scroll to surround said discharge chamber.

5. A scroll-type compressor according to claim 4, further comprising a discharge port formed through said movable scroll base plate for discharging a gas from the final closed space into said discharge port, and a discharge valve arranged on the back surface of said movable scroll base plate to open and close said discharge port.

6. A scroll-type compressor according to claim 5, further comprising a pressure receiving plate arranged between said front housing and said movable scroll base plate.

7. A scroll-type compressor according to claim 6, wherein said sealing device comprises a first sealing ring arranged between said front housing and said pressure receiving plate and a second sealing ring arranged between said pressure receiving plate and said movable scroll base plate.

8. A scroll-type compressor according to claim 2, wherein said rotation preventing mechanism is arranged between said movable scroll base plate and said front housing.

9. A scroll-type compressor according to claim 1, further comprising a rear housing attached to said stationary scroll, said stationary scroll being arranged between said movable scroll and said rear housing.

10. A scroll-type compressor according to claim 9, wherein said rear housing supports at least one end of said rotatable shaft by a radial bearing.

11. A scroll-type compressor according to claim 10, further comprising a motor housing attached to said rear housing, said rear housing supporting one end of said rotatable shaft by said radial bearing, said motor housing supporting the other end of said rotatable shaft by a further radial bearing.

12. A scroll-type compressor according to claim 1, wherein said movable scroll having a boss portion on the side of said movable spiral wall with respect to said movable scroll base plate, said boss portion having a cavity, and wherein said orbital rotating mechanism comprises an eccentric shaft connected to or integral with said rotatable shaft, and a bearing device fitted in said cavity of said boss portion and on said eccentric shaft.

13. A scroll-type compressor according to claim 12, wherein said movable spiral wall is arranged around said boss portion.

14. A scroll-type compressor according to claim 13, wherein said stationary scroll base plate has a bore in which said boss portion rotatably extends.

15. A scroll-type compressor according to claim 14, further comprising a rear housing attached to said stationary scroll, said rear housing having a bore through which said rotatable shaft extends.

16. A scroll-type compressor according to claim 1, wherein said rotation preventing mechanism comprises pins attached to one of said front housing and said movable scroll base plate, and holes arranged in the other of said front housing and said movable scroll base plate, aid pins being arranged in said holes such that the outer peripheral surfaces of said pins contact the inner peripheral surfaces of said holes.

* * * * *